United States Patent [19]

Head

[11] Patent Number: 4,541,216

[45] Date of Patent: Sep. 17, 1985

[54] SUSPENDED CEILING SYSTEM

[75] Inventor: Thomas F. Head, Amherst, N.H.

[73] Assignee: Environmental Interiors, Inc., Nashua, N.H.

[21] Appl. No.: 570,434

[22] Filed: Jan. 16, 1984

Related U.S. Application Data

[63] Continuation of Ser. No. 278,640, Jun. 29, 1981.

[51] Int. Cl.[4] ..... E04B 5/52

[52] U.S. Cl. ..... 52/484; 52/483; 52/489; 52/665; 52/772

[58] Field of Search ..... 52/28, 39, 484, 475, 52/145, 488, 222, 716, 762, 780, 781, DIG. 8, 772, 777, 290, 483, 489, 665

[56] References Cited

U.S. PATENT DOCUMENTS

| | | | |
|---|---|---|---|
| 1,865,131 | 6/1932 | Olsen | 52/DIG. 8 |
| 2,863,180 | 12/1958 | Birowell et al. | 52/403 |
| 2,946,415 | 7/1960 | Fischer | 52/773 |
| 3,000,474 | 9/1961 | Friedman et al. | 52/484 |
| 3,141,206 | 7/1964 | Stephens | 52/403 |
| 3,312,030 | 4/1967 | Gillespie | 52/773 |
| 3,387,872 | 6/1968 | Lovuzzo et al. | 52/DIG. 8 |
| 3,397,500 | 8/1968 | Watson, Jr. | 52/781 |
| 3,407,555 | 10/1968 | Pugh | 52/780 |
| 3,565,473 | 2/1971 | Kedel | 52/484 |
| 3,877,190 | 4/1975 | Corcoran, Jr. | 52/781 |
| 4,063,396 | 12/1977 | Attaway | 52/489 |
| 4,117,642 | 10/1978 | Eckert et al. | 52/489 |
| 4,206,578 | 6/1980 | Mieyal | 52/484 |
| 4,245,446 | 1/1981 | Judkins | 52/484 |
| 4,272,937 | 6/1981 | Brugman | 52/484 |
| 4,328,653 | 5/1982 | Anderle | 52/489 |

FOREIGN PATENT DOCUMENTS

| | | | |
|---|---|---|---|
| 734140 | 5/1966 | Canada | 52/478 |
| 604756 | 5/1960 | Italy | 52/481 |
| 7614614 | 7/1978 | Netherlands | 52/666 |

*Primary Examiner*—Donald G. Kelly
*Assistant Examiner*—Michael Safavi
*Attorney, Agent, or Firm*—Cesari and McKenna

[57] ABSTRACT

A suspended ceiling system employs an array of stringers suspended from an overhead building support. Ceiling panels are positioned by the stringers and each panel interlocks with a plurality of stringers so that it resists upward or downward displacement relative to the stringers. If the system employs rectangular panels, they are attached to the stringers from above. If it utilizes linear wooden panels, they are attached to the stringers from below.

1 Claim, 6 Drawing Figures

SUSPENDED CEILING SYSTEM

This application is a continuation of application Ser. No. 278,640, filed June 29, 1981.

BACKGROUND OF THE INVENTION

This invention pertains to suspended ceiling systems, and particularly to such systems in which panels or strips are suspended on stringers from an overhead support.

Suspended ceiling systems are particularly desirable for designing aesthetic and architecturally creative decor. They can be used for both interior and exterior applications, and not only on ceilings, but also on overhanging surfaces. Such a system generally includes panels or strips that are suspended from floor joists or other overhead supports on an assembly of stringers.

In one prior system of which we are aware, metal stringers having inverted T-shaped cross-sections are arranged in a grid across the ceiling of a room, thus effectively forming rectangular frames. A panel is inserted from above into each frame and rests on the lateral arms or flanges of the stringers. An annoying problem with such an arrangement is that each panel merely sits on the stringers. As a result, the panels can easily be displaced upwards and knocked out of place.

Another example of the prior art is a so-called linear ceiling system. In this system, the panels are in the form of long, roll-formed metal channels arranged parallel to each other with an exposed recess or relief between each pair.

The panels are supported by orthogonal stringers, each formed with a lengthwise series of laterally spaced-apart downwardly extending tabs that are hook-shaped to form one part of a snap fit. The side walls of the channel have edges which are rolled inward so that each panel can be attached to a pair of tabs on each of a plurality of stringers. Thus the panels can be suspended in spaced parallel alignment along their entire lengths. The main problem with a linear ceiling system such as this employing metal channels as panels is that the decorative effects that can be achieved are limited. In other words, the panels invariably have a solid color covering of paint or enamel. They cannot, therefore, contribute to the more rustic, woody motifs desired for some living spaces.

SUMMARY OF THE INVENTION

Accordingly, an object of this invention is to provide a suspended ceiling system whose panels are not subject to being displaced or dislodged from their supports.

Another object of the invention is to provide a suspended linear ceiling system whose panels can be composed of actual boards or slats having a pronounced wood grain.

Still another object of the invention is to provide such a system whose panels can be installed relatively quickly and easily on their supporting stringers.

Yet another object is to provide wood grain panels which can be retrofit on the stringers of a conventional suspended ceiling system.

Other objects will, in part, be obvious and will, in part, appear hereinafter.

The invention accordingly comprises the features of construction, combination of elements and arrangement of parts which will be exemplified in the following detailed description, and the scope of the invention will be indicated in the claims.

In summary, the subject ceiling system includes multiple panels that are supported on and locked to an assembly of stringers suspended from overhead building structure. The stingers are arranged as two orthogonal, spaced, parallel arrays so as to form a rectangular grid. Each stringer has an inverted T-shaped configuration whose horizontal arms form shelves all around the cells or openings defined by the stringer grid. Furthermore, the vertical leg of each stringer in at least one of the arrays is bifurcated with the two upper edge margins of each such leg being turned back on themselves in opposite directions to define a resilient lip or overhang on opposite sides of that leg.

The panels utilized in this system embodiment are formed as sheet metal or plastic pans. The pans have substantially the same size and shape as the stringer grid openings and they are formed with a flat bottom wall and integral outwardly angled sidewalls. Each such panel is arranged to seat in an opening in the grid with the panel bottom wall resting on the arms of the T-shaped stringers bounding that opening.

The height and slant of the panel sidewalls are such that, as each panel is seated in its grid opening, the sidewalls resiliently engage the leg edge margins of the stringers defining that opening. Then when the panel actually rests on those arms, the overhanging lips formed by those margins on the stringer legs engage over the edges of the panel thus locking the panel in place.

Thus, each panel in the system is supported from below by the arms of the stringers on which it rests and is restrained from upward displacement by the overhanging lips formed on the legs of the stringers at opposite edges of the panel. Accordingly, accidental dislodgement of panels in the ceiling is inhibited, if not prevented entirely.

In another version of the invention, the suspended ceiling system employs panels in the form of long linear strips made preferably of wood. Each strip is provided with clips which are spaced along its length. Each of these clips has laterally spaced, upwardly extending, resilient legs. These panels are also arranged to be supported by an array of stringers suspended from overhead building structure. In this case, however, the stringers are positioned parallel to one another and are relatively widely spaced.

Each stringer is formed with a lengthwise series of downwardly extending tabs, the lengthwise spacing between adjacent tabs being more or less the same as the spacing between the clip arms on the strip-like panels. Also, alternate tabs terminate in noses or projections which project in opposite directions along the stringer. Each panel is oriented perpendicular to the stringers and is of a length to intersect at least two and preferably more stringers in the array. The panel is anchored to each stringer by engaging the clips attached to that panel onto an adjacent pair of tabs depending from that stringer. Thus a multiplicity of panels can be supported in parallel, side-by-side along their lengths by the stringer array.

The widths of the wood strips comprising the panels are such that a lengthwise space is provided between adjacent panels. Since the space above the ceiling system is usually dark, while the living space below the ceiling is illuminated naturally or by electric lights, the spaces between the adjacent panels appear as dark shadow-like bands. This emphasizes the linear effect provided by the parallel panels and accentuates the woody grained character of the wood strips comprising the panels. The overall effect, then, is a ceiling system which is very distinctive and natural in appearance as compared with prior linear ceiling systems employing painted, roll-formed metal channels.

While in both ceiling system versions, the panels are firmly anchored to the stringer components of the system, they can be removed if need be to gain access to the space above the ceiling or for other reasons. Finally, with all of the above advantages, the ceiling systems made in accordance with this invention are still relatively inexpensive to make and maintain.

BRIEF DESCRIPTION OF THE DRAWINGS

For a fuller understanding of the nature and objects of the invention, reference should be had to the following detailed description, taken in connection with the accompanying drawings, in which.

DESCRIPTION OF THE PREFERRED EMBODIMENTS

Figure 1:
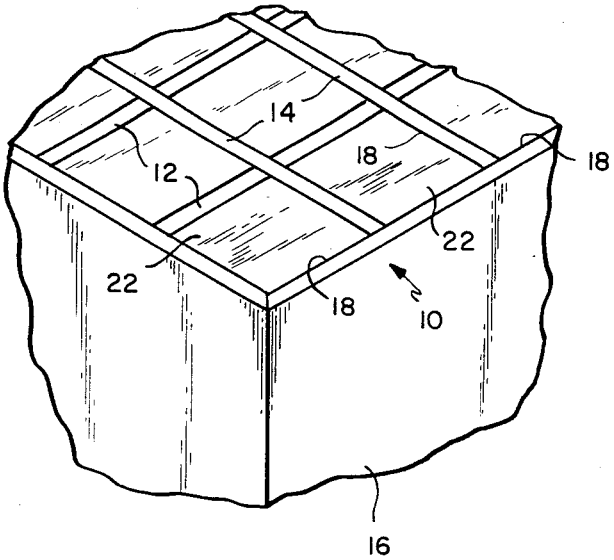
FIG. 1 is a perspective view from below of a suspended ceiling system embodying the principles of this invention.

Refer first to FIG. 1 of the drawings which shows one embodiment of a suspended ceiling system made in accordance with this invention, which system is indicated generally at 10. The system includes two orthogonal arrays of spaced-apart parallel stringers 12 and 14. As shown in FIG. 1, the stringers 12 and 14 are positioned at the top of a living space 16, being suspended by hangers 24 (FIG. 2) from overhead horizontal floor joists or other similar supports (not shown). The stringers 12 and 14 are conventional in that they interlock forming a generally rectangular grid defining individual rectangular openings or cells 18. Positioned in each opening 18 and completing the ceiling system are a multiplicity of generally rectangular panels 22.

Figure 2:
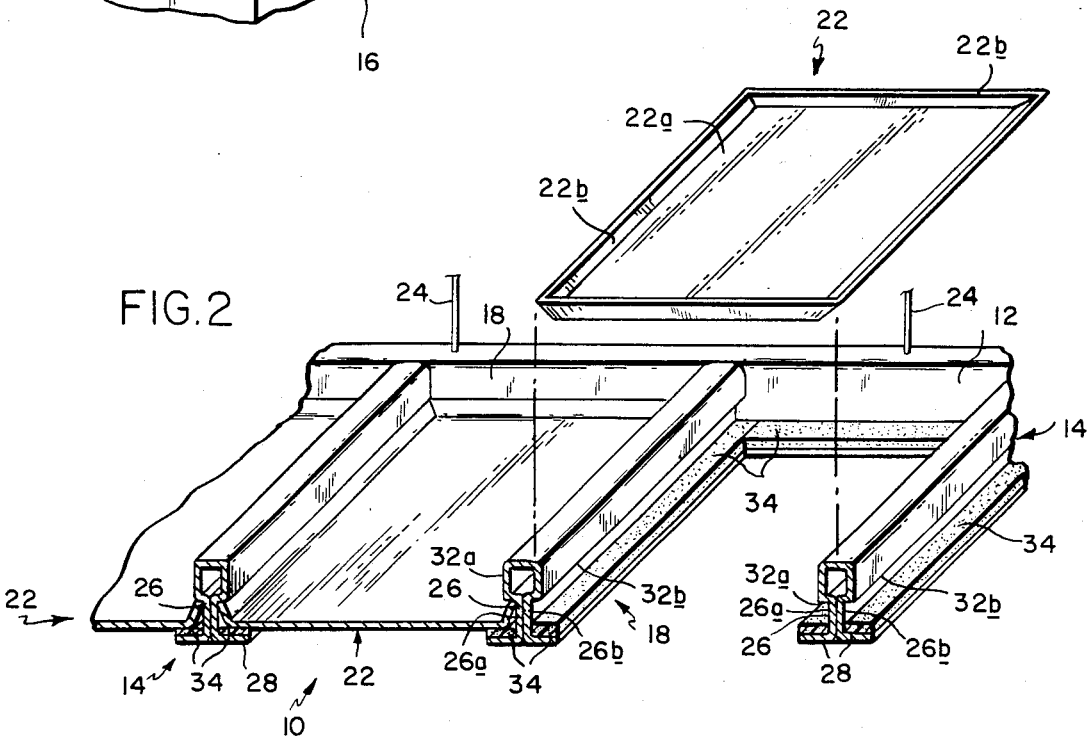
FIG. 2 is an exploded fragmentary perspective view from above on a larger scale showing the system in greater detail.

Referring now to FIG. 2, the individual stringers 12 and 14 are suspended from their overhead supports by hangers 24 so that the stringers lie substantially in a horizontal plane. Each stringer 12, 14 is similar in that each has an inverted T-shaped cross-section. That is, it has a generally vertical leg indicated at 26 terminated at its lower end by a pair of oppositely directed horizontal arms 28 projecting into the stringer grid openings 18 on opposite sides of the corresponding leg 26.

Figure 3:
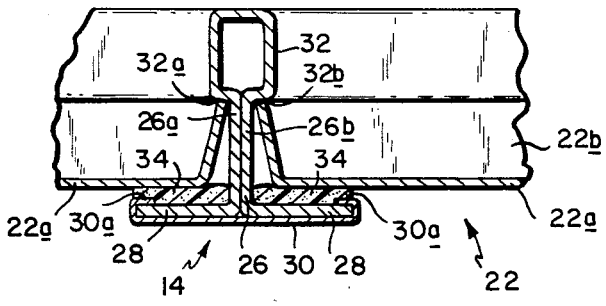
FIG. 3 is a fragmentary sectional view on a still larger scale illustrating the mode of assembling the FIG. 1 system.

However, as best seen in FIGS. 2 and 3, the stringer leg 26 of each stringer 14 comprises back-to-back layers **26*a* and 26*b*, joined at the top by an integral rigidifying box rib 32. The lower edge margins of these layers are turned out away from one another to form the arms 28. The metal strip comprising each stringer is formed or rolled so that the box rib 32 at the upper edges of the stringer forms a pair of lips or overhangs 32*a* and 32*b* which project laterally from opposite sides of the leg 26. The lips 32*a* and 32*b*, of course, project out on opposite sides of the leg 26 so that they extend into the adjacent stringer grid openings 18**.

Figure 3A:
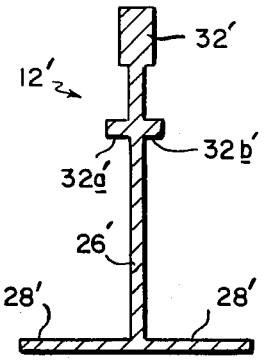
FIG. 3A is a sectional view on a larger scale of a modified stringer for use in the FIG. 1 system.

Alternatively, if, desired, particularly for heavy duty applications, the stringer can be formed as a unitary extruded piece, rather than being roll-formed. An extruded stringer such as this is illustrated at 12' in FIG. 3A. Its parts-correspondence to stringer 12 is indicated by the same identifying numbers with primes.

As shown in FIG. 3, a thin metal strip 30 is placed flush against the undersides of the stringer arms 28. That strip is wide enough such that its edges **30*a*** can be clinched around the arm edges to provide a finished surface at the exposed underside of each stringer.

As best seen in FIG. 2, each panel 22 comprises a generally rectangular bottom wall **22*a* and integral side walls 22*b* which extend upwardly and outwardly so that each panel forms a generally rectangular pan. Typically, the walls lie at an angle of from 5° to 10° from the vertical and the panel dimensions are such that they fit snugly in the stringer grid openings 18**.

Each panel 22 may be dropped from above into an opening 18 in the stringer grid. As the panel approaches the underlying stringer arms 28, its outwardly splayed side walls **22*b* resiliently engage the sides of the box rib 32 formed on the legs 26 of the stringers 14 defining the opposite sides of the opening 18. The panel 22 can then be pushed down toward the underlying stringer arms 28**.

The heights of the panel side walls **22*b* are related to the heights of the lips 32*a* and 32*b* above their underlying stringer arms 28 such that, when the panel bottom wall 22*a* seats on those arms 28, the free edges of the panel side walls 22*b* just clear the lips 32*a* and 32*b*. Since the panel side walls are somewhat resilient, as soon as the panel seats on the stringer arms 28, its edges spring out to some extent so that they underlie the stringer lips 32*a*, 32*b* as shown in FIG. 3**. Therefore, it is highly unlikely that the panel can be dislodged or displaced by upward forces on that panel.

In a preferred embodiment of my ceiling system, a relatively thick (e.g. $\frac{1}{8}$ inch) adhesive backed foam tape 34 is adhered to the upper surface of the stringer arms 28. These strips 34 form seals between the undersides of the panels 22 and the stringers. Also being resilient, they tend to bias the panel side wall edges against the undersides of the stringer lips **32*a*, 32*b***, to further lock the panels in place.

As seen in FIG. 1, when an array of panels 22 are seated properly on their respective stringers, the resultant ceiling system completely covers the living space 16, presenting an attractive decorative overhead surface. Of course, the panels 22 can have different surface treatments and can even be colored differently so as to form a checkerboard design or some other design at the ceiling of the living space.

Although the aforementioned ceiling system forms a completely closed secure ceiling surface, the individual panels comprising the system are easily installed as shown above simply by pressing them down into their associated stringer openings until their edges engage under the stringer lips **32*a* and 32*b*. The panels 22 themselves are easily formed by stamping them out of metal or plastic and the stringers 14** are more or less conventional except for their lip-forming box ribs which perform the strengthening of panel-locking functions described above. Therefore, the ceiling system described above is relatively inexpensive to make and should find wide application in homes, office spaces and the like.

Figure 4:
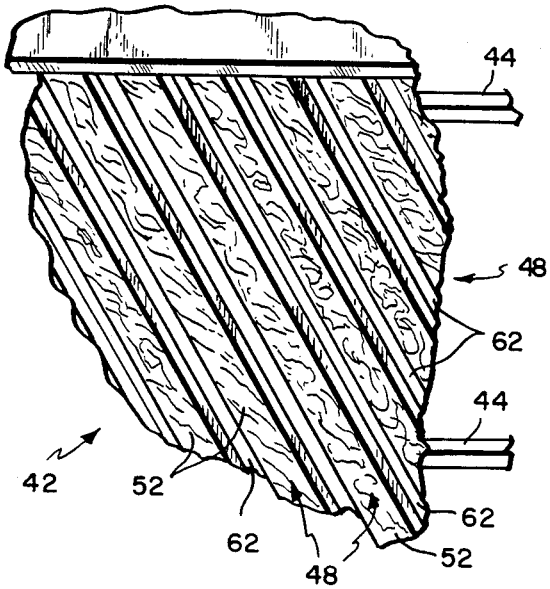
FIG. 4 is a view similar to FIG. 1 of another embodiment of a ceiling system according to the invention.
Figure 5:
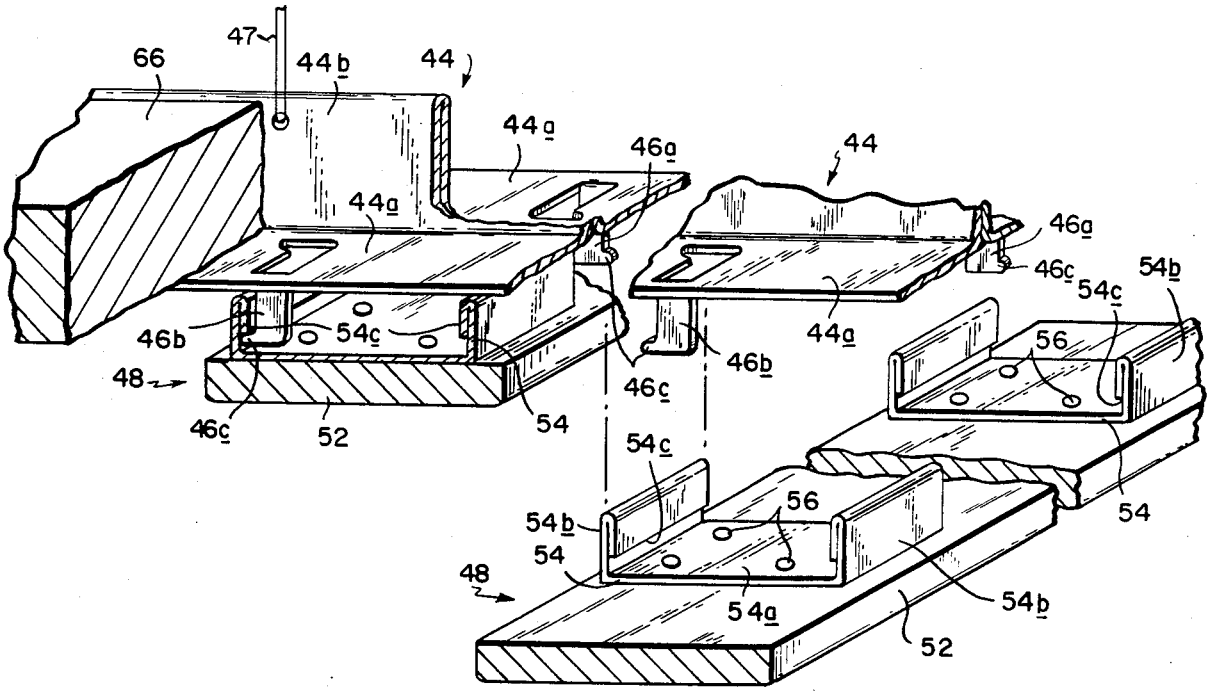
FIG. 5 is a view similar to FIG. 2 showing that second embodiment in greater detail.

Refer now to FIGS. 4 and 5 which illustrate another version of my suspended ceiling system which creates a so-called linear effect. This system shown generally at 42 in FIG. 4 utilizes inverted T-shaped stringers 44 which are suspended parallel to one another by hangers 47 (FIG. 5) from overhead floor joists or other building structure. In this case, however, the stringers are relatively widely spaced apart and may only extend in one direction, i.e. transversely in FIG. 4.

Each stringer 44 comprises a pair of arms 44*a* and an upstanding leg 44*b*. A lengthwise series of tabs or hooks 46*a* and 46*b* are struck alternately from the two stringer arms 44*a* of each stringer. These tabs project down below the stringer and terminate in lengthwise extending noses 46*c*. However, the noses of adjacent tabs 46*a* and 46*b* project in opposite directions. In other words, as shown in FIG. 5, the noses of all tabs 46*a* project toward the right, while the noses of tabs 46*b* extend toward the left.

Supported by stringers 44 are a series of elongated panels shown generally at 48. Each such panel comprises a long narrow wood strip or board 52. The strip 52 may be finished or left unfinished, but in either event, it retains its natural wood grain as seen in FIG. 4.

Secured to the upper surface of each wood strip 52 is a lengthwise series of clips 54. Each clip is a rolled metal, generally U-shaped part having a relatively flat back 54*a* and a pair of laterally spaced-apart legs 54*b*. Each clip is anchored to its strip 52 by nails, screws or other suitable fasteners 56 which extend through the clip back 54*a* into strip 52.

As best seen in FIG. 5, the clip legs 54*b* lie parallel to the edges of the associated wood strip 52, being spaced somewhat inboard of those edges. The upper edge margins of each clip leg 54*b* is turned inward and back on itself to form a lip or overhang 54*c* at the inboard surface of the leg about half way up thereon.

The spacing between the clip legs 54*b* is more or less the same as the space between the pairs of stringer tabs 46*a*, 46*b* having oppositely directed noses 46*c*, permitting the panel clips 54 to be clipped to those tab pairs as shown in FIG. 5. When each panel 48 is engaged against the underside of stringer 44 and pushed upwards, the resilient legs 54*b* of the clips attached to that panel spread apart to accommodate the tab noses 46*c* of the pair of tabs between them. When the lips 54*c* on the clips clear those noses, the clip legs snap together thereby interlocking the lips 54*c* and tab noses 46*c* to securely anchor the panel 48 to the stringer. Each panel is clipped along its length to the corresponding tab pair 46*a*, 46*b* of a plurality of stringers. Therefore, it is suspended in a horizontal plane. Furthermore, the adjacent tab pairs are separated so that adjacent panels can be secured in the same fashion in spaced parallel relation to one another leaving a gap or recess 62 between them as best seen in FIG. 4.

Thus this mode of locking panels 48 to their stringers 44 permits the panels to be made of an aesthetically pleasing material such as wood which cannot, as can the prior metal channels used for this purpose, be formed with rolled-in edges for interlocking with the stringers. When all the panels 48 are mounted to their respective stringers as aforesaid, there results a ceiling composed of the spaced-apart, parallel natural wood boards or strips 52 separated by narrow gaps 62 as shown in FIG. 4. Since the living space below ceiling system 42 is usually illuminated while the space above the ceiling is relatively dark, the gaps 62 appear as dark parallel shadow bands between the illuminated strips 52. This produces a linear design which is particularly appealing to the eye.

In some applications, it is desirable to position relatively thick (e.g. 1 or 2 inch) panels of black sound absorbing media on the stringer arms 44*a*. A fragment of such a panel is illustrated at 66 in FIG. 5. These panels are sized to fill the entire area between stringers 44 and help to minimize sound transmission.

As with the FIG. 1 embodiment of any system, the linear ceiling version is relatively inexpensive to make and easy to install, no special tools or equipment being needed to securely attach the panels to their stringers. Therefore, both versions should find wide application in interior and even exterior decoration.

It will thus be seen that the objects set forth above, among those made apparent from the preceding description, are efficiently attained, and, since certain changes may be made in the above constructions without departing from the scope of the invention, it is intended that all matter contained in the above description or shown in the accompanying drawings be interpreted as illustrative and not in a limiting sense.

It is also to be understood that the following claims are intended to cover all of the generic and specific features of the invention herein described.

What is claimed as new and desired to be secured by Letters Patent of the United States is:

1. A suspended ceiling system comprising

A. an assembly of spaced-apart parallel stringers suspended in a horizontal plane, each stringer being formed with a pair of flat laterally extending flanges, B. a series of rigid hooks spaced along each stringer, adjacent ones of said hooks having small side edge protuberances which project in opposite directions along the stringer, each said hook comprising a relatively small flat area of a stringer flange struck from that flange and bent downward along a line parallel to the longitudinal axis of the stringer into a plane substantially perpendicular to the stringer flanges so that the side edges of the hook face the opposite ends of the stringer, adjacent hooks in the series formed along each stringer being struck from opposite stringer flanges, C. multiple elongated wood strips, D. a lengthwise series of clips mounted permanently along the length of each strip, each clip having laterally spaced-apart resilient legs each of whose ends is bent back on itself to form a lip, the spacing between the legs being no greater than the width of the strip to which it is mounted and corresponding to the spacing between adjacent stringer hooks on the same stringer so that said legs can be resiliently engaged to said adjacent hooks so as to cover said hooks whereby all of the strips can be supported along both their side edges in parallel spaced-apart relation with the hooks and clips connected behind them and with said leg lips overhanging said protuberances of the rigid hooks to which they are engaged.

* * * * *